US008701654B2

(12) United States Patent
Newburger et al.

(10) Patent No.: US 8,701,654 B2
(45) Date of Patent: Apr. 22, 2014

(54) EXERCISE MAT AND SYSTEM FOR ENSURING PROPER FORM AND POSTURE DURING EXERCISE

(75) Inventors: Amy Newburger, Greenwich, CT (US); Paula Carnabuci, Cold Spring, NY (US)

(73) Assignee: Fitness Form Group, LLC, Greenwich, CT (US)

( * ) Notice: Subject to any disclaimer, the term of this patent is extended or adjusted under 35 U.S.C. 154(b) by 0 days.

(21) Appl. No.: 13/184,175

(22) Filed: Jul. 15, 2011

(65) Prior Publication Data

US 2012/0053029 A1 Mar. 1, 2012

Related U.S. Application Data

(63) Continuation of application No. 11/825,988, filed on Jul. 10, 2007, now Pat. No. 8,025,614.

(51) Int. Cl.
*A63B 21/00* (2006.01)

(52) U.S. Cl.
USPC ..... 128/23; 128/148; 128/130

(58) Field of Classification Search
USPC ..... 128/23, 148, 130, 142, 872; 297/465, 297/466; 5/81.1, 922, 926
See application file for complete search history.

(56) References Cited

U.S. PATENT DOCUMENTS

| | | | | |
|---|---|---|---|---|
| 4,858,625 | A | 8/1989 | Cramer | |
| 5,333,623 | A * | 8/1994 | Fuller | 128/875 |
| 5,439,008 | A | 8/1995 | Bowman | |
| 5,551,934 | A | 9/1996 | Binette | |
| 6,042,189 | A | 3/2000 | Wellman | |
| 6,560,793 | B2 | 5/2003 | Walker | |
| 7,207,932 | B1 | 4/2007 | Dean | |

* cited by examiner

*Primary Examiner* — Jerome w Donnelly
(74) *Attorney, Agent, or Firm* — Andrews Kurth LLP

(57) ABSTRACT

An exercise system preferably having a mat dimensioned to support a user stretched out on the floor. The mat has a central fastening band disposed widthwise across the mat. A belt fits around the midsection of the user adapted to be aligned with and at least partially adhere to the fastening band of the mat. The user is intended to perform certain flexibility exercises with the belt in contact with the fastening band. If the user lifts her midsection off of the mat during such exercises, the removal of the belt makes an audible noise (and the mat tugs on the user) to cue the user to reposition her body flat on the mat. The fastening band preferably includes one half of a hook-and-loop-type fastener and the belt comprises the other mating half. Alternatively, one or both of the band and belt may be provided with an adhesive material.

29 Claims, 3 Drawing Sheets

EXERCISE MAT AND SYSTEM FOR ENSURING PROPER FORM AND POSTURE DURING EXERCISE

CROSS-REFERENCE TO RELATED APPLICATIONS

The present application is a continuation of U.S. patent application Ser. No. 11/825,988 filed on Jul. 10, 2007, now U.S. Pat. No. 8,025,614 the content of which is incorporated herein by reference.

FIELD OF THE INVENTION

The invention relates to exercise equipment pertaining to stretching, yoga, abdominal muscle core-based exercises, and other similar exercises performed whilst on a mat on the floor. More specifically, the invention relates to a new mat and belt that ensures that a person performing stretching, yoga, or the like maintains the correct positioning of his or her body during the exercises so as to maximize the benefit received from the exercise and minimize the chance of injury during the exercise.

BACKGROUND OF THE INVENTION

Exercise is fundamental and critical for maintaining good health. It is important to perform a wide variety of different types of exercises for the best results, e.g., cardiovascular, strength training, resistance training, stretching, flexibility, yoga, etc. Many of these exercises can be performed by a person merely positioning his or her body in different configurations and/or repeatedly moving various parts of the body. A mat is often used to provide the person with a cushioned and cleaner surface on which to exercise than on the floor.

Among the abdominal core-based exercise methodologies, Pilates may be the most well known. These exercise systems focus on improving flexibility and strength for the total body, without building body mass or bulk. Pilates was created by a nurse/therapist named Joseph Pilates. This, similar to other abdominal muscle core-based exercises, is designed to strengthen the so-called critical core muscles that support, align and maintain the spine, among other benefits. In recent years, Pilates and similar exercises have entered the fitness mainstream. Over 10 million Americans are now believed to practice Pilates or a similar abdominal muscle core-based exercise regimen, and the number continues to grow.

Concomitant with its rapid success, Pilates and other exercise regimes are offered with some element of risk. For example, many people take large group exercise classes in which individual attention is limited or substantially nil. Many more people purchase pre-recorded exercise videos and exercise at home with absolutely no input from a live instructor. Even with proper supervision, many people have a very difficult time planting their midsections (lower backs when supine, pelvic region when prone, or hip when on one's side) against the floor or mat, leaving them not only confused, but frustrated, and worse yet susceptible to injury. At the least, improper position and alignment may not be as beneficial as proper body location and placement. A workout is most effective when one locks into one's core muscles and works the body in essence from the "inside out." To successfully exercise using the Pilates system, one must have the ability to secure or plant the body down, articulate the spine, and keep the torso and pelvis relatively stable. One may benefit from a personal trainer who is adequately educated, however it is an expensive option, and it is not available for many who work out at home in large groups, or alone, in any event.

Strengthening the abdominal core muscles and these types of body exercises are believed to be a crucial part of rehabilitation after back injury and/or surgery. The present device is considered highly useful for these purposes, too. Even bedridden patients need abdominal muscle strengthening exercises to maintain muscle tone. Again, the present invention is considered highly beneficial in that regard. Urinary incontinence sufferers, too, whose incontinence is based on a lack of pelvic muscle tone may also benefit from exercises by use of the present invention.

There is thus believed a long and widely-felt need for a simple, inexpensive means of ensuring a person keeps the relevant portion (usually the torso) of his or her body down in contact with the floor or mat while working and exercising the rest of the body. Abdominal muscle core-based exercising is believed to be highly beneficial but results are considered maximized when the exercisers correct positioning is maintained.

SUMMARY OF THE INVENTION

The invention is an exercise system having a mat dimensioned to support a user stretched out on the floor. The mat has a substantially central fastening band attached to it and disposed widthwise substantially across the mat. A belt is provided, fittable around the midsection of the user and adapted to be aligned with and at least partially adhere to the fastening band of the mat. The user is intended to perform exercises with the belt in contact with the fastening band. If the user inadvertently lifts her midsection off of the mat during exercise, the removal of the belt will be against a force and further, such inappropriate movement makes an audible noise to audibly cue the user to reposition and/or maintain her body flat on the mat. The fastening band of the mat preferably includes one half of a hook-and-loop-type fastener, and the belt comprises the other mating half of the hook-and-loop-type fastener. Alternatively, one or both of the band and belt may be provided with an adhesive material. As another alternative, the fastening band can be directly mounted to a floor, wall, or other workout surface and not made integral with a mat or other portable structure (i.e., a studio may be provided with one or more fastening band "stations" secured to the floor or wall(s), while individuals bring their respective belts to the studio).

In one embodiment of the present invention is an exercise system comprising an exercise surface having a length and a width, the length being longer than the width. A fastening band extends along the width of the surface; the fastening band is located substantially towards a center of the length. A belt is adapted to fit around a user, the belt adapted to align parallel to the fastening band when the user lays down on the exercise surface. The belt cooperates with the fastening band to provide tactile feedback to the user when at least a portion of the belt is removed from the fastening band and the belt maintains cooperation with the fastening band during, but allows for, rotational movement of the user.

In some embodiments, the fastening band comprises one half of a hook-and-loop type fastener. In some embodiments, the belt comprises the other half of the hook-and-loop type fastener. In some embodiments, the fastening band extends the entire width of the exercise surface. In some embodiments, the belt is releasably attached to the fastening band. In some embodiments, the belt is sized to extend only around a midsection of a user. In some embodiments, a noise is generated when the belt is detached from the fastening band. In some embodiments, the exercise surface is a mat. In some embodiments, the fastening band is about 8 inches in height. In some embodiments, the belt is adjustable to fit around different sized users. In some embodiments, the mat is foldable in three sections.

In another embodiment of the present invention is an exercise system comprising an exercise surface having a fastening band and a belt adapted to fit around a user. The belt cooperates with the fastening band to provide tactile feedback to the user when at least a portion of the belt is removed from the fastening band and the belt maintains cooperation with the fastening band during, but allows for, rotational movement of the user.

In some embodiments, the belt is adapted to align parallel to the fastening band when the user lays down on the exercise surface. In some embodiments, the fastening band comprises one half of a hook-and-loop type fastener. In some embodiments, the belt comprises the other half of the hook-and-loop type fastener. In some embodiments, the belt is releasably attached to the fastening band. In some embodiments, the belt is sized to extend only around a midsection of a user. In some embodiments, a noise is generated when the belt is detached from the fastening band. In some embodiments, the exercise surface is a mat. In some embodiments, the fastening band is about 8 inches in height. In some embodiments, the belt is adjustable to fit around different sized users. In some embodiments, the mat is foldable in three sections. In some embodiments, In another embodiment of the present invention is a method of using an exercise system comprising the steps of placing an exercise mat on a floor, the exercise mat having a fastening band, placing a belt around a midsection of a user, and laying down on the exercise mat aligning and engaging the belt with the fastening band.

In some embodiments, the method further includes a step of rotating the user so a different part of the belt engages the fastening band. In some embodiments, the method further includes a listening for a noise when the user inadvertently lifts their midsection from the mat. In some embodiments, the method further includes a step providing tactile feedback when the user inadvertently lifts their midsection from the mat. In some embodiments, the method further includes a step of replacing the midsection of the user on the mat after hearing the noise. In some embodiments, the method further includes a step of replacing the midsection of the user on the mat after feeling the tactile feedback. In some embodiments, the method further includes a step of generating a noise using a hook-and-loop type fastener when the belt is removed from the fastening band. In some embodiments, the method further includes a step of unfolding the mat prior to placing the mat on the floor. In some embodiments, the method further includes a step of performing a workout using the exercise system. In some embodiments, the method further includes a step of removing the mat from the floor and folding up the mat after the workout is finished.

DETAILED DESCRIPTION OF THE INVENTION

Description of the invention will now be given with reference to FIGS. 1-8. It should be understood that these figures are exemplary in nature and in no way serve to limit the scope of the invention, which is defined by the claims appearing herein below.

Figure 1:
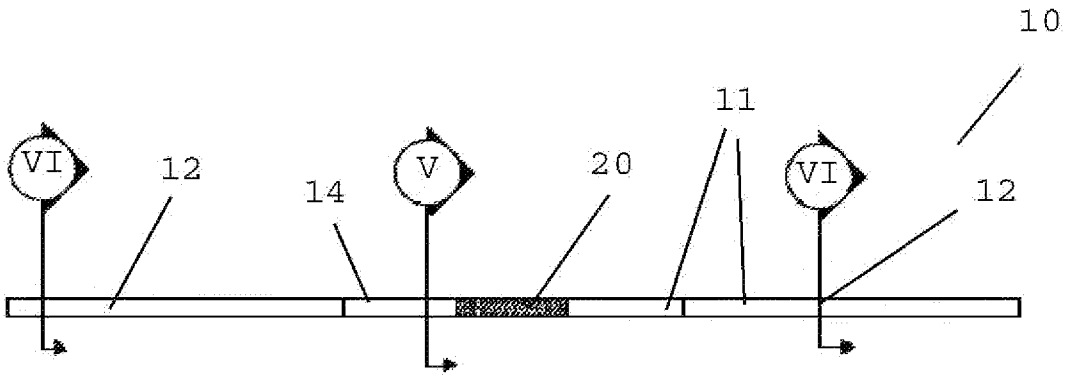
FIG. 1 is a side elevation view of a mat unfolded in accordance with the invention.
Figure 2:
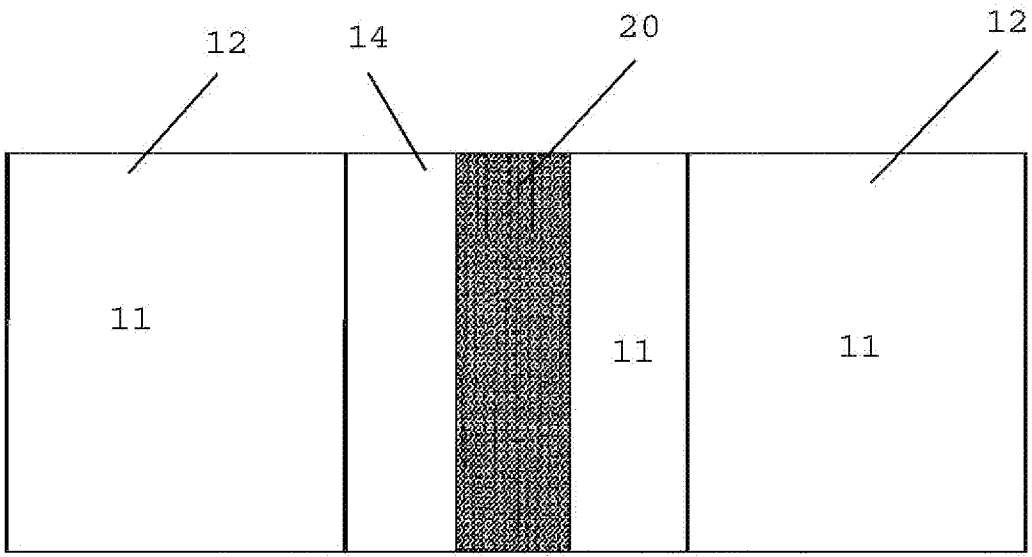
FIG. 2 is a top plan view of the unfolded mat of FIG. 1 in accordance with the invention.
Figure 4:
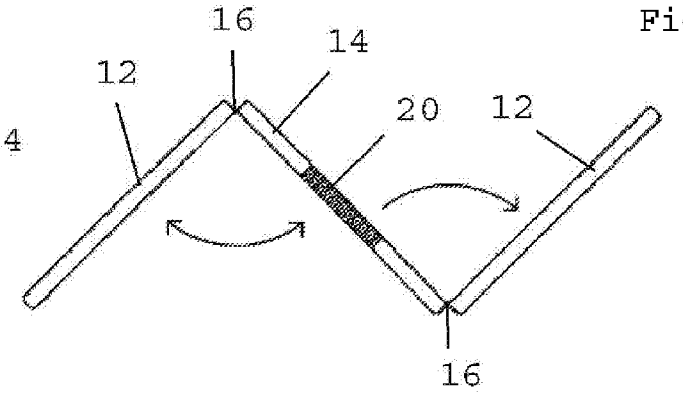
FIG. 4 is a side elevation view of the mat of FIGS. 1-3 as it is being unfolded.
Figure 3:
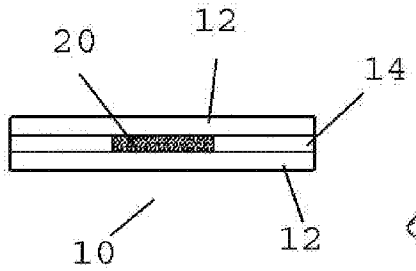
FIG. 3 is a side elevation view of the mat of FIGS. 1-2 in accordance with the invention, folded into a storage configuration.
Figure 5:
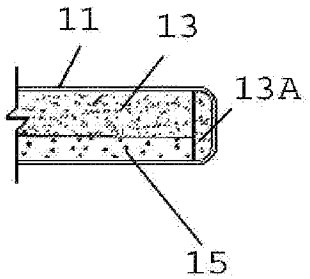
FIG. 5 is a partial, and sectional view of a central section of the mat of FIGS. 1-4, taken along line V of FIG. 1.
Figure 6:
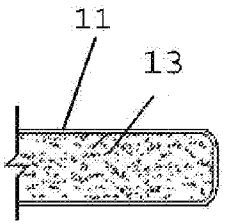
FIG. 6 is a partial, and sectional view of the upper and lower sections of the mat of FIGS. 1-4 taken along lines VI of FIG. 1.
Figure 7:
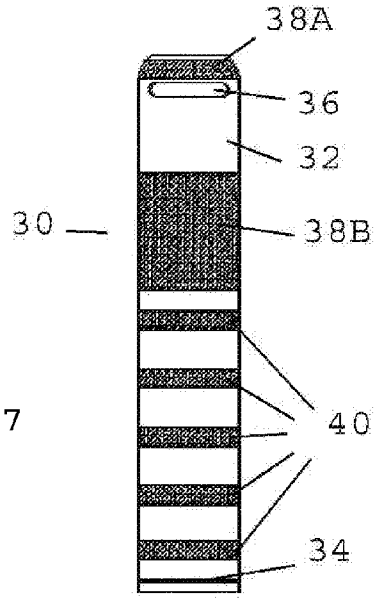
FIG. 7 is a top plan view of a belt in accordance with the invention.
Figure 8A:
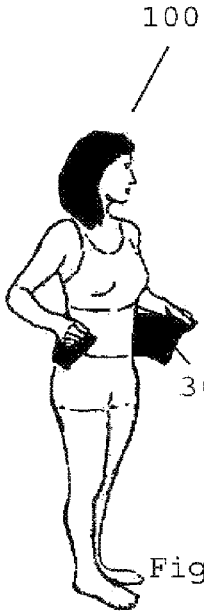
FIGS. 8A-G are schematics depicting the use of the invention by an exerciser.
Figure 8B:
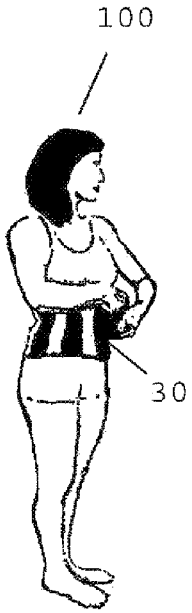
Figure 8C:
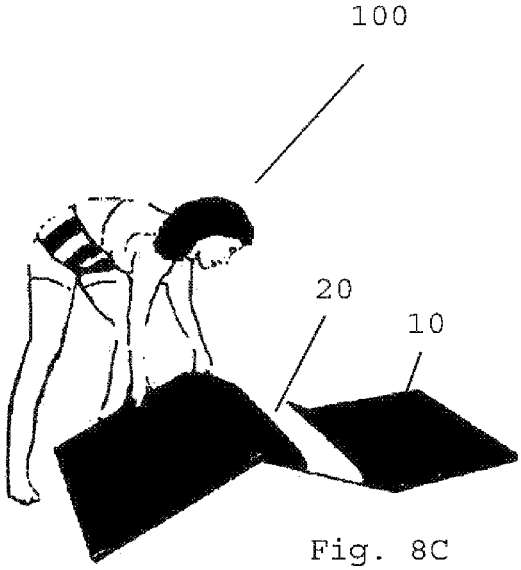
Figure 8D:
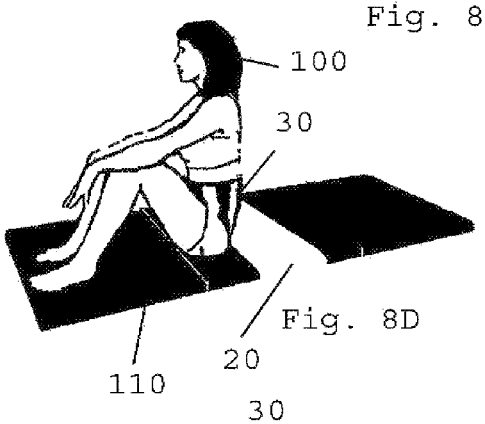
Figure 8E:
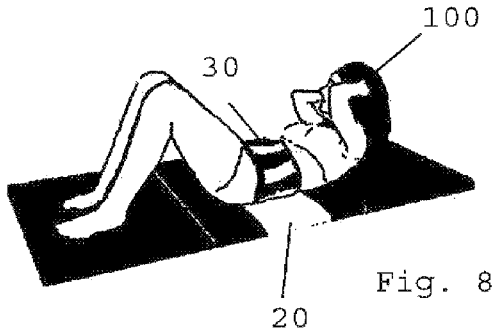
Figure 8F:
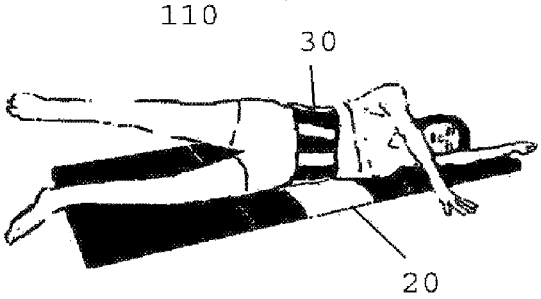
Figure 8G:
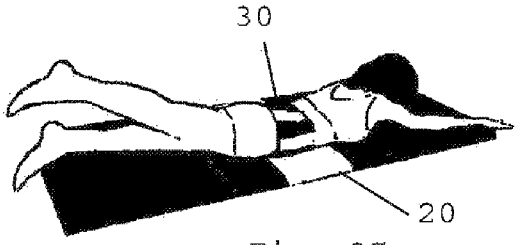

The main components of the inventive exercise system are mat 10 (FIGS. 1-6) and belt 30 (FIG. 7). Mat 10 is preferably a three-sectioned exercise mat having a plastic (preferably vinyl) covering 11 and padding therein. It preferably includes upper and lower sections 12 and a central section 14 although the mat can be formed of one, two or more sections, as desired. As shown in FIGS. 3 and 4, the sections 12 and 14 are hingedly attached at hinges 16 (e.g., thin non-padded vinyl or fabric hinges) and can be folded up into a storage configuration (FIG. 3) or unfolded (FIG. 4) into a working configuration (FIGS. 1 and 2). As shown in FIGS. 5 and 6, the padding provided to sections 12 and 14 may include high density foam 13 in all sections, with the central section 14 having a layer of ultra-light mid-density foam 15 (See FIG. 5) as well. Central section 14 may also be provided with shaped high density foam edging 13A.

Central section 14 of mat 10 is also provided with fastening band 20 disposed widthwise substantially all the way across mat 10. In the preferred embodiment, fastening band 20 is one half of a hook-and-loop-type fastener such as Velcro® (e.g., band 20 is the hook portion). By "hook-and-loop-type fastener," it is intended to mean any Velcro®-like fastening system having one strip of repeating elements that matingly engage with another strip of repeating elements, and is not meant to be limited specifically to Velcro® In the preferred embodiment fastening band 20 is centered in central section 14 and spans about one third of the length of the central section 14, having a top edge that extends a distance away from the top of the mat and a bottom edge that extends a distance away from the bottom of the mat; however, fastening band 20 may be placed anywhere along mat 10.

The other main component of the invention is belt 30 (see FIG. 7) which includes a main body 32 of preferably at least somewhat elastic material and a main belt loop 34. Pull slot 36 is provided at one end of belt 30, along with belt tip fastener 38A. Belt tip fastener 38A, preferably one half of a hook-and-loop-type fastener, is designed to be pulled (with the belt first wrapped around a wearers waist) through belt loop 34 and then folded back so that belt tip fastener 38A matingly engages corresponding or mating belt fastening section 38B (preferably the other half of the hook-and-loop-type fastener of that provided on belt tip fastener 38A) to enable belt 30 to be cinched snugly around the midsection or waist of a user. Belt loop 34 is secured at its ends to the side of the belt 30 but is sufficiently resilient or long to allow the belt tip 38A to pass between it and the belt portion beneath the belt loop 34. Other fastening systems may be employed for belt 30 instead of fastener 38A-B, e.g., snaps, buttons, etc. Additionally, belt 30 may be made as a continuous elastic loop with no fastener which the user slips her legs through to place around her midsection.

Belt 30 may be provided with one or more strips 40 of one half of hook-and-loop-type fastener—the opposite half of that which makes up fastening band 20. It is preferred (but not required) to provide the fastening portion of belt 30 as multiple, discrete transverse strips 40 rather than a continuous section of fastening material so that belt 30 is more flexible, more comfortable, and more able to conform to the contours of the user. It is also preferred because if the adhering strength of the belt to the mat is too great and the fastening portion of belt 30 extends continuously around belt 30, belt 30 will be too tightly secured to mat 10 and the mat will simply move along with the user through both correct and incorrect postures. Thus, strips 40 are adapted to engage and at least partially adhere to fastening band 20 when a person wearing belt 30 lies down atop mat 10 in the proper position, and separate from fastening band 20 when the user moves out of contact with the mat, i.e., out of the proper position. In a preferred embodiment, five strips 40 are provided, 1.5 inches wide with 3 inch spaces between adjacent strips on a 42-inch long belt that is 8 inches across. The corresponding fastening band 20 in this embodiment is 8 inches wide and spans across mat 10 as shown in the drawings. The invention is not limited to these specific dimensions. Strips 40 engage fastening band 20 when the belt is worn and the wearer positions one's torso onto the mat.

In many exercises, it is preferred for the exerciser to keep her midsection as flat as possible against the mat, floor, wall, or other workout surface. The user of the inventive system will be provided with an audible signal i.e., she will hear when her midsection moves off of mat 20, in that the separation of hook-and-loop-type fastener elements from one another makes a noise. The user will hear this telltale noise and know to (try to) replant her midsection back down on the mat.

Use of the invention is shown schematically in FIG. 8. User 100 wraps belt 30 around her midsection in FIG. 8A and secures belt tip fastener 38A through belt loop 34, bends it back over the loop 34 and onto fastening section 38B in FIG. 8B. The hand grip 36 helps the user to tighten the belt. User 100 opens up mat 10 so that it is flat on the floor and so that fastening band 20 is facing upward, as in FIG. 8C (alternatively, fastening band may be provided on both main faces of mat 10 so that it does not matter which face is up). User 100 sits down on mat 10 (FIG. 8D) placing her posterior 110 near fastening band 20 so that, when she lies back down as in FIG. 8E, one or more strips 40 of belt 30 matingly engage, in a substantially parallel direction, and at least partially adhere to fastening band 20. In FIG. 8E, user 100 is doing abdominal "crunches," in which she should preferably only raise her upper body and legs while keeping her midsection flat and down on the mat. Should the user inadvertently and improperly lift her midsection as well as her upper body, or should she arch her lower back, strips 40 on belt 30 will pull away from fastening band 20 on mat 10 and generate an audible sound to cue the user to keep her posture correct. Furthermore, the corresponding hook and loop fastener facilitates maintaining correct positioning and exercise by tending to hold one's midsection flat onto the mat. User 100 may use the mat and belt system while lying on her side (see FIG. 8F) or lying prone (see FIG. 8G) as well. If a user rotates their body, at least a portion of belt 30 will maintain contact with fastening band 20, so that no matter which direction user 100 is facing (i.e. up, down, left, or right) belt 30 can always maintain some contact with fastening band 20 and provide tactile and audible feedback if the user lifts their midsection off of mat 10. For example, belt 30 can maintain contact with fastening band 20 if the user rotates from their back to their side.

The invention is not limited to the above description. For example, it is described that the fastening band 20 has one of the hooks or loops of the Velcro®-type fastener and the belt 30 has the other, however both the band and the belt may be provided with both sections of the hook portion and sections of the loop portion of the Velcro-type fastener. Additionally, for the embodiment provided with a sticky surface or adhesive on at least one of the fastening band 20 and the belt 30, the adhesive may be provided on one of or both of the band and the belt. As another alternative, the fastening band need not be attached to a mat but may be installed or placed directly onto a floor, a wall, or other workout surface.

Having described certain embodiments of the invention, it should be understood that the invention is not limited to the above description or the attached exemplary drawings. Rather, the scope of the invention is defined by the claims appearing herein below and any equivalents thereof as would be appreciated by one of ordinary skill in the art.

What is claimed is:

1. An exercise system comprising:

a mat having a length and a width, said length being longer than said width;

a fastening band extending substantially across an entire width of said mat, said fastening band having a top edge that extends a predetermined distance away from a top-most portion of said mat and a bottom edge that extends a distance away from a bottom-most portion of said mat; and a belt adapted to fit around a user, said belt adapted to align parallel to said fastening band when the user lays down on said mat, wherein said belt cooperates with said fastening band to provide tactile feedback to the user when at least a portion of said belt is removed from said fastening band and said belt maintains cooperation with said fastening band during, but allows for, rotational movement of the user.

2. The exercise system of claim 1, wherein said fastening band comprises one half of a hook-and-loop type fastener.

3. The exercise system of claim 2, wherein said belt comprises the other half of the hook-and-loop type fastener.

4. The exercise system of claim 1, wherein said fastening band extends the entire width of said mat.

5. The exercise system of claim 1, wherein said belt is releasably attached to said fastening band.

6. The exercise system of claim 5, wherein a noise is generated when said belt is detached from said fastening band.

7. The exercise system of claim 1, wherein said fastening band is about 8 inches in height.

8. The exercise system of claim 1, wherein said mat is foldable in three sections.

9. An exercise system comprising:

a mat having a fastening band;

a belt adapted to fit around a user;

wherein said belt cooperates with said fastening band to provide tactile feedback to the user when at least a portion of said belt is removed from said fastening band and said belt maintains cooperation with said fastening band during a rotational movement of the user from a first position to a second position, wherein the first position is a position at which the user is positioned substantially on a back of the user, and the second position is a position at which the user is positioned substantially on a side of the user.

10. The exercise system of claim 9, wherein said belt is adapted to align parallel to said fastening band when the user lays down on said mat.

11. The exercise system of claim 9, wherein said fastening band comprises one half of a hook-and-loop type fastener.

12. The exercise system of claim 11, wherein said belt comprises the other half of the hook-and-loop type fastener.

13. The exercise system of claim 9, wherein said belt is releasably attached to said fastening band.

14. The exercise system of claim 9, wherein said belt is sized to extend only around a midsection of a user.

15. The exercise system of claim 13, wherein a noise is generated when said belt is detached from said fastening band.

16. The exercise system of claim 9, wherein said fastening band is about 8 inches in height.

17. The exercise system of claim 9, wherein said belt is adjustable to fit around different sized users.

18. The exercise system of claim 9, wherein said mat is foldable in three sections.

19. A method of using an exercise system comprising the steps of:

placing an exercise mat on a floor, the exercise mat having a fastening band;

placing a belt around a midsection of a user, wherein the belt cooperates with the fastening band to provide tactile feedback to the user when at least a portion of the belt is removed from the fastening band and the belt maintains cooperation with the fastening band during a rotational movement of the user from a first position to a second position, wherein the first position is a position at which the user is positioned substantially on a back of the user, and the second position is a position at which the user is positioned substantially on a side of the user; and laying down on the exercise mat aligning and engaging the belt with the fastening band.

20. The method of claim 19, further comprising the step of rotating the user so a different part of the belt engages the fastening band.

21. The method of claim 19, further comprising the step of listening for a noise when the user inadvertently lifts their midsection from the mat.

22. The method of claim 19, further comprising the step of providing tactile feedback when the user inadvertently lifts their midsection from the mat.

23. The method of claim 21, further comprising the step of replacing the midsection of the user on the mat after hearing the noise.

24. The method of claim 22, further comprising the step of replacing the midsection of the user on the mat after feeling the tactile feedback.

25. The method of claim 19, further comprising the step of generating a noise using a hook-and-loop type fastener when the belt is removed from the fastening band.

26. The method of claim 19, further comprising the step of unfolding the mat prior to placing the mat on the floor.

27. The method of claim 19, further comprising the step of performing a workout using the exercise system.

28. The exercise system of claim 1, wherein said mat is at least partially covered with a plastic material.

29. The exercise system of claim 1, wherein said mat is made of, at least in part, a high density foam.

* * * * *